US007510253B2

(12) United States Patent
Tatsumi

(10) Patent No.: US 7,510,253 B2
(45) Date of Patent: Mar. 31, 2009

(54) IMAGE FORMING DEVICE AND IMAGE FORMING METHOD

(75) Inventor: Daisuke Tatsumi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 341 days.

(21) Appl. No.: 11/344,566

(22) Filed: Jan. 31, 2006

(65) Prior Publication Data

US 2007/0019015 A1 Jan. 25, 2007

(30) Foreign Application Priority Data

Jul. 20, 2005 (JP) ..... 2005-209957

(51) Int. Cl.
*B41J 2/205* (2006.01)
*B41J 2/17* (2006.01)

(52) U.S. Cl. ..... 347/14; 347/96

(58) Field of Classification Search ..... 347/14, 347/96

See application file for complete search history.

(56) References Cited

U.S. PATENT DOCUMENTS 6,135,656 A * 10/2000 Kato et al. ..... 347/14
6,264,320 B1 * 7/2001 Moriyama et al. ..... 347/96
2004/0160470 A1 * 8/2004 Billow et al. ..... 347/19

FOREIGN PATENT DOCUMENTS

| | | |
|---|---|---|
| JP | 8-281932 | 10/1996 |
| JP | 11-309882 | 11/1999 |
| JP | 11-334114 | 12/1999 |
| JP | 2002-321349 | 11/2002 |
| JP | 2005-007649 | 1/2005 |

* cited by examiner

*Primary Examiner*—Julian D Huffman
(74) *Attorney, Agent, or Firm*—Fildes & Outland, P.C.

(57) ABSTRACT

The present invention provides an image forming device which forms an image by ejecting an ink drop and a reaction liquid drop which reacts with the ink drop. The image forming device includes: an ink drop ejecting data generating component, a reaction liquid ejecting data generating component, and an image forming component. The ink drop ejecting data generating component, on the basis of image data, generates ink drop ejecting data. The reaction liquid ejecting data generating component generates reaction liquid ejecting data, on the basis of ink drop ejecting data of a pixel of interest and the like. The image forming component forms an image by ejecting the ink drop on the basis of the ink drop ejecting data and ejecting the reaction liquid drop on the basis of the reaction liquid ejecting data.

17 Claims, 15 Drawing Sheets

40
CONTROL SECTION
30
RESOLUTION CONVERTING SECTION
32
COLOR CONVERTING SECTION
34
QUANTIZING SECTION
36
INK EJECTING DATA GENERATING SECTION
38
RECORDING HEAD DRIVING SECTION
42
CONVEYING SYSTEM
44
REACTION LIQUID EJECTING DATA GENERATING SECTION
46
REACTION LIQUID HEAD DRIVING SECTION

FIG.7

| IMAGE DATA | RATIO OF REACTION LIQUID AMOUNT |
|---|---|
| 0 | 0.0 |
| 1 | 0.0 |
| ⋮ | ⋮ |
| 127 | 0.1 |
| 128 | 0.1 |
| ⋮ | ⋮ |
| 254 | 0.2 |
| 255 | 0.2 |

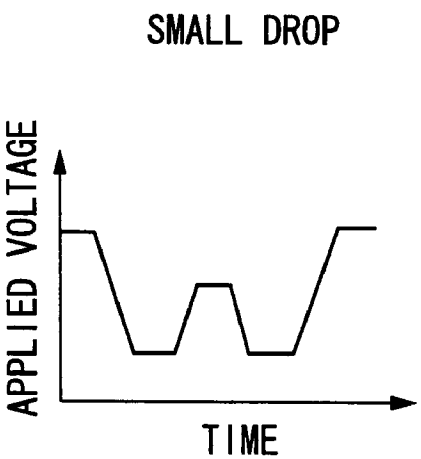
FIG.8A
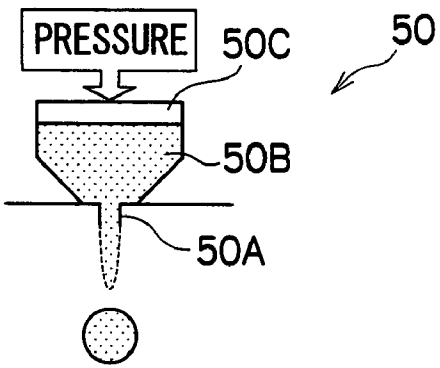
FIG.8B
FIG.8C
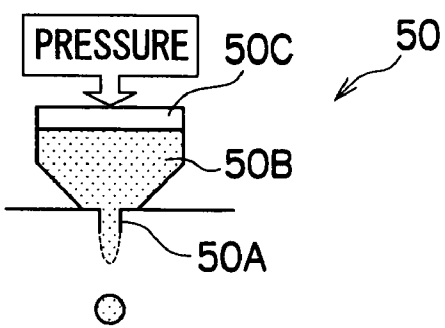
FIG.8D

IMAGE FORMING DEVICE AND IMAGE FORMING METHOD

CROSS-REFERENCE TO RELATED APPLICATION

This application claims priority under 35 USC 119 from Japanese Patent Application No. 2005-209957, the disclosure of which is incorporated by reference herein.

BACKGROUND OF THE INVENTION

1. Field of the Invention

The present invention relates to an image forming device and an image forming method which form an image by ejecting ink drops and reaction liquid drops which react with the ink drops.

2. Description of the Related Art

Inkjet printers, which are equipped with a recording head at which a plurality of nozzles which eject liquid drops are arranged, and which carry out recording of an image by ejecting ink drops from the nozzles, are currently coming into wide use.

In recent years, in order to improve the image density and in order to overcome the spreading of inks into the sheet and the blurring between colors which arises at portions where different colors contact one another, inkjet printers have employed a method of applying onto a sheet, in addition to the inks of the respective colors, a reaction liquid which reacts with the inks (a printability improving liquid which causes the coloring materials within the inks to cohere, thicken, or become insoluble).

When using a reaction liquid, if the amount of the reaction liquid is too large, problems arise in that the total amount of moisture which the sheet absorbs is large and wrinkles form in the sheet, or the reaction liquid goes to waste when it is ejected at unneeded regions on the sheet.

Thus, various techniques have conventionally been proposed in order to eject an appropriate amount of reaction liquid at a desired position.

For example, there has been proposed an inkjet printing device which generates data for ejecting reaction liquid (synonymous with processing liquid) by computing the logical sum of ink ejecting data (see, for example, Japanese Patent Application Laid-Open (JP-A) No. 08-281932).

There have also been proposed an inkjet recording device which assigns reaction liquid data, by using a dither pattern, from data for the ink after halftone processing (see, for example, JP-A No. 11-334114), and an inkjet recording device which carries out thinning of respective density ink data by using a mask and generates reaction liquid data by computing the logical sum of the mask pattern and the reaction liquid data after thinning, thereby making the amounts of reaction liquid to be ejected differ in accordance with the amount of or the type of the coloring material of each ink to be ejected from a recording head onto a recording material (see, for example, JP-A No. 2002-321349). Further, there is also known an inkjet recording device which, when the image density is less than or equal to a predetermined density, generates data for a reaction liquid which is for applying reaction liquid to the same place as the place to which ink is applied on the basis of data for the ink, and, when the image density is greater than the predetermined density, generates data for a reaction liquid so as to apply reaction liquid to places from which are thinned out places where ink is applied on the basis of the data for the ink (see, for example, JP-A No. 11-309882).

An inkjet recording method, which applies reaction liquid when the ink duty is greater than or equal to a predetermined value and which does not apply reaction liquid when the ink duty is less than or equal to the predetermined value, also is known (see, for example, JP-A No. 2005-007649). In this inkjet recording method, reaction liquid data is generated by error diffusion, without relation to the ink data.

However, in an inkjet printing device such as proposed in JP-A No. 08-281932, there is the problem that fine control with respect to the ink amount cannot be carried out merely by computing the logical sum.

Further, in inkjet recording devices such as proposed in JP-A Nos. 11-334114, 2002-321349, and 11-309882, the reaction liquid data generating pixels depend on the mask (the dither pattern). Therefore, there is the problem that bias arises in generating the reaction liquid data, depending on the relationship between the ink data and the mask. Further, the reaction liquid amount cannot be freely adjusted merely by thinning by using the dither pattern. In addition, such methods cannot address cases in which it is desired to change the amount of the reaction liquid at the first color or the second color.

In an inkjet recording method such as proposed in JP-A No. 2005-007649, because the reaction liquid data is generated by error diffusion and without relation to the ink data, there are cases in which reaction liquid which is more than needed is applied even to regions where the application of reaction liquid is not necessary or only a small amount thereof suffices, such as regions in which ink drops are not formed, low density regions, or the like. Accordingly, the reaction liquid is consumed wastefully.

SUMMARY OF THE INVENTION

The present invention has been made in view of the above circumstances, and provides an image forming device and an image forming method.

A first aspect of the present invention is an image forming device forming an image by ejecting an ink drop and a reaction liquid drop which reacts with the ink drop, the image forming device having: an ink drop ejecting data generating component which, on the basis of image data, generates ink drop ejecting data for ejecting an ink drop; a reaction liquid ejecting data generating component which generates reaction liquid ejecting data for ejecting a reaction liquid drop, on the basis of ink drop ejecting data of a pixel of interest, an error which was diffused to the pixel of interest from a peripheral pixel when reaction liquid ejecting data was generated previously, and a predetermined ratio of a reaction liquid amount to an ink amount; and an image forming component which forms an image by ejecting the ink drop on the basis of the ink drop ejecting data and ejecting the reaction liquid drop on the basis of the reaction liquid ejecting data.

A second aspect of the present invention is an image forming method forming an image by ejecting an ink drop and a reaction liquid drop which reacts with the ink drop, the image forming method including: on the basis of image data, generating ink drop ejecting data for ejecting an ink drop; generating reaction liquid ejecting data for ejecting a reaction liquid drop, on the basis of ink drop ejecting data of a pixel of interest, an error which was diffused to the pixel of interest from a peripheral pixel when reaction liquid ejecting data was generated previously, and a predetermined ratio of a reaction liquid amount to an ink amount; and forming an image by ejecting the ink drop on the basis of the ink drop ejecting data and ejecting the reaction liquid drop on the basis of the reaction liquid ejecting data.

A third aspect of the present invention is a data generating device generating reaction liquid ejecting data which is used in an image forming device which forms an image by ejecting an ink drop on the basis of ink drop ejecting data and ejecting a reaction liquid drop, which reacts with the ink drop, on the basis of the reaction liquid ejecting data, wherein the data generating device generates the reaction liquid ejecting data on the basis of ink drop ejecting data of a pixel of interest, an error which was diffused to the pixel of interest from a peripheral pixel when reaction liquid ejecting data was generated previously, and a predetermined ratio of a reaction liquid amount to an ink amount.

A fourth aspect of the present invention is a data generating method generating reaction liquid ejecting data which is used in an image forming device which forms an image by ejecting an ink drop on the basis of ink drop ejecting data and ejecting a reaction liquid drop, which reacts with the ink drop, on the basis of the reaction liquid ejecting data, wherein the reaction liquid ejecting data is generated on the basis of ink drop ejecting data of a pixel of interest, an error which was diffused to the pixel of interest from a peripheral pixel when reaction liquid ejecting data was generated previously, and a predetermined ratio of a reaction liquid amount to an ink amount.

A fifth aspect of the present invention is a storage medium readable by a computer, the storage medium storing a program of instructions executable by the computer to perform a function for generating reaction liquid ejecting data which is used in an image forming device which forms an image by ejecting an ink drop on the basis of ink drop ejecting data by ejecting a reaction liquid drop, which reacts with the ink drop, on the basis of the reaction liquid ejecting data, wherein the reaction liquid ejecting data are generated on the basis of ink drop ejecting data of a pixel of interest, an error which was diffused to the pixel of interest from a peripheral pixel when reaction liquid ejecting data was generated previously, and a predetermined ratio of a reaction liquid amount to an ink amount.

BRIEF DESCRIPTION OF THE DRAWINGS

Embodiments of the present invention will be described in detail based on the following figures, wherein:

FIG. 7 is an example of a relationship table which prescribes the relationships between image data of 256 gradations before halftone processing, and a ratio T of a reaction liquid amount to an ink amount;

FIGS. 8A through 8D are diagrams schematically explaining the structure of a liquid drop ejector, the driving waveform of voltage applied to a piezoelectric element of the liquid drop ejector, and the size of a dot ejected in accordance with the driving waveform;

DETAILED DESCRIPTION OF THE INVENTION

Embodiments of the present invention will be described in detail hereinafter with reference to the drawings.

Figure 1:
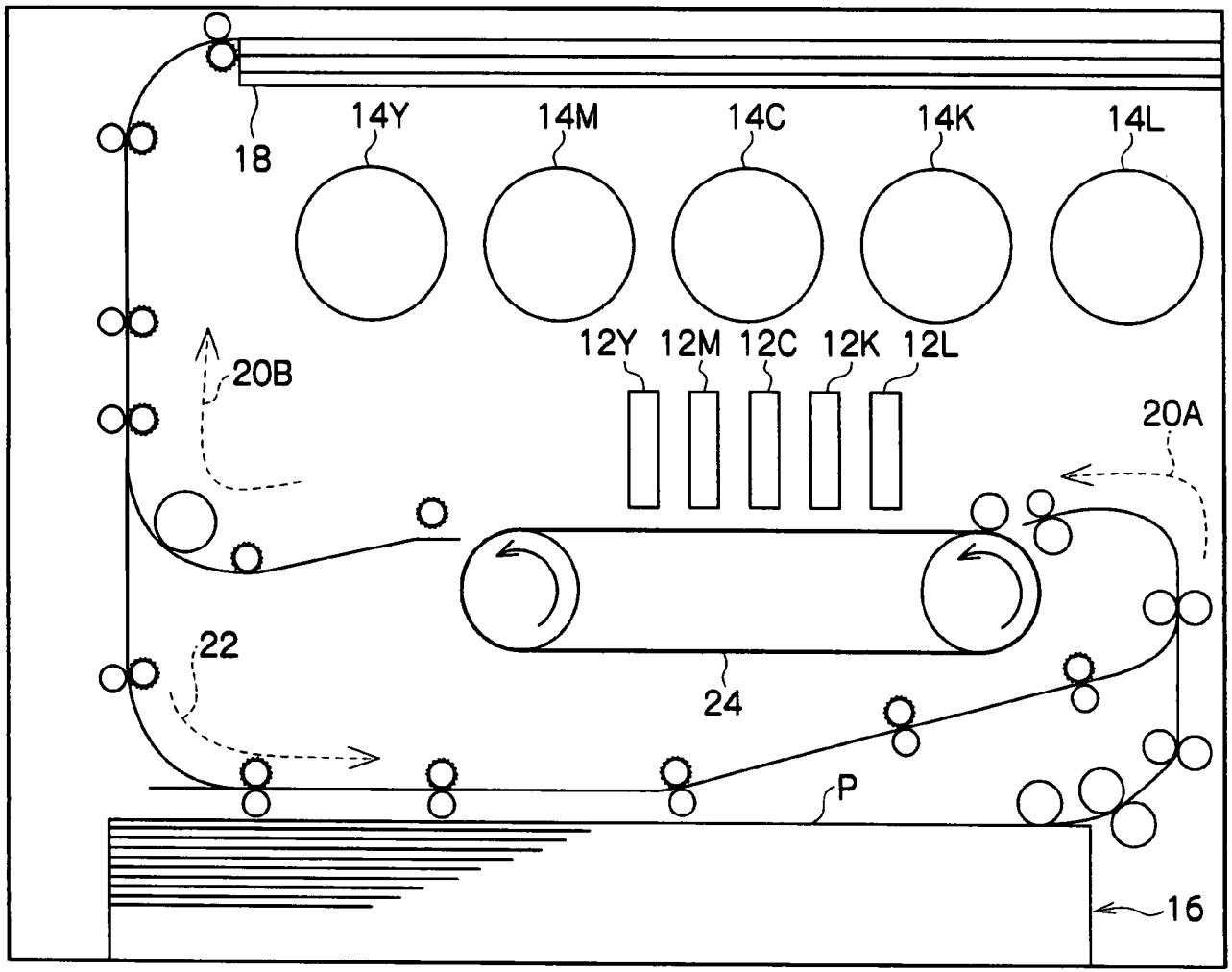
FIG. 1 is a schematic structural diagram of an inkjet recording device relating to an embodiment of the present invention.

As shown in FIG. 1, in an inkjet recording device 10 serving as an image forming device relating to the embodiment of the present invention, a reaction liquid head 12L, which ejects a reaction liquid, and recording heads 12K, 12C, 12M, 12Y, which correspond to the respective colors of K (black), C (cyan), M (magenta) and Y (yellow), are arranged from the upstream side with respect to the conveying direction of a sheet P. The inkjet recording device 10 has ink tanks 14Y, 14M, 14C, 14K which accommodate inks to be supplied to the recording heads 12K through 12Y, and a reaction liquid tank 14L which accommodates reaction liquid to be supplied to the reaction liquid head 12L.

Various types of known inks, such as aqueous inks, oil-based inks, solvent inks, and the like, can be used as the inks which are stored in the ink tanks 14K through 14Y.

The reaction liquid which is stored in the reaction liquid tank 14L is a reaction liquid which reacts with the inks, and improves the image density by causing the coloring materials within the inks to cohere, thicken, or become insoluble, and overcomes the spreading of inks into the sheet and the blurring between colors which arises at portions where different colors contact one another. The image quality can be improved by applying ink drops and the reaction liquid such that the reaction liquid and the inks of the respective colors are overlapped. Examples of the reaction liquid are organic acid reaction liquids, polyvalent metal reaction liquids, reaction liquids which are a mixed type of an organic acid and a polyvalent metal, reaction liquids which are a mixed type of an organic acid and an organic amine, and the like. However, the reaction liquid is not limited to these, and it suffices for the reaction liquid to be a reaction liquid which, by reacting with the ink, improves the image density and reduces blurring of dots.

The respective recording heads 12K through 12Y and the reaction liquid head 12L respectively have the same structures. Therefore, hereinafter, when explanation is given without particularly distinguishing between them, the final letter of the reference numeral will be omitted, and they will merely be called "the heads 12".

The inkjet recording device 10 has a sheet feed tray 16 which accommodates sheets P serving as recording media, an endless-belt-shaped conveying body 24 which is disposed so as to oppose the heads 12 and conveys the sheets P, and a sheet discharge tray 18 into which the sheets are discharged after printing.

A plurality of conveying rollers are provided in the inkjet recording device 10, so as to form a first conveying path, which is structured by a path 20A from the sheet feed tray 16 to the conveying body 24 and a path 20B from the conveying body 24 to the sheet discharge tray 18, and a second conveying path 22 in the opposite direction from the path 20B of the first conveying path to the conveying body 24.

Further, at the path 20A of the first conveying path, the sheets P are conveyed one-by-one from the sheet feed tray 16 by a plurality of conveying rollers to the conveying body 24. At the path 20B, the sheet P arrives at the sheet discharge tray 18 by a plurality of conveying rollers. In the present embodiment, the second conveying path 22 is provided so that the sheet can be reversed and double-sided printing is possible.

The conveying body 24 has a belt which is placed around two rollers. Attractive force due to the supplying of charges can be used as the method for holding the sheet P by the conveying body 24. Namely, the sheet is pressed against the belt by a charging roller, and charges are applied to the sheet P so as to generate an attractive force.

The head 12 is structured such that a plurality of liquid drop ejectors 50 (see FIG. 8B or FIG. 8D), which eject ink drops or reaction liquid drops, are arranged in a direction orthogonal to the sheet conveying direction (the direction orthogonal to the sheet conveying direction is called the main scanning direction), at a head bar of a length corresponding to the width of the sheet P. The head 12 has a recording region corresponding to the maximum width of the sheet P. In the inkjet recording device 10, liquid drops can be ejected out onto the entire width of the sheet P by carrying out recording while conveying only the sheet P and keeping the head 12 fixed without main-scanning the head 12.

As shown in FIGS. 8B and 8D, the liquid drop ejector 50 is structured so as to include a liquid drop pressure chamber 50B which communicates with a nozzle 50A for ejecting ink drops, and a piezoelectric element 50C which is provided so as to contact the liquid drop pressure chamber 50B. As is known, the piezoelectric element 50C has the property that the shape thereof changes due to voltage being applied thereto. By utilizing this change in the shape, pressure is applied to the interior of the liquid drop pressure chamber 50B, and an ink drop or a reaction liquid drop is ejected from the nozzle 50A, and a dot is recorded on the sheet P.

Figure 2:
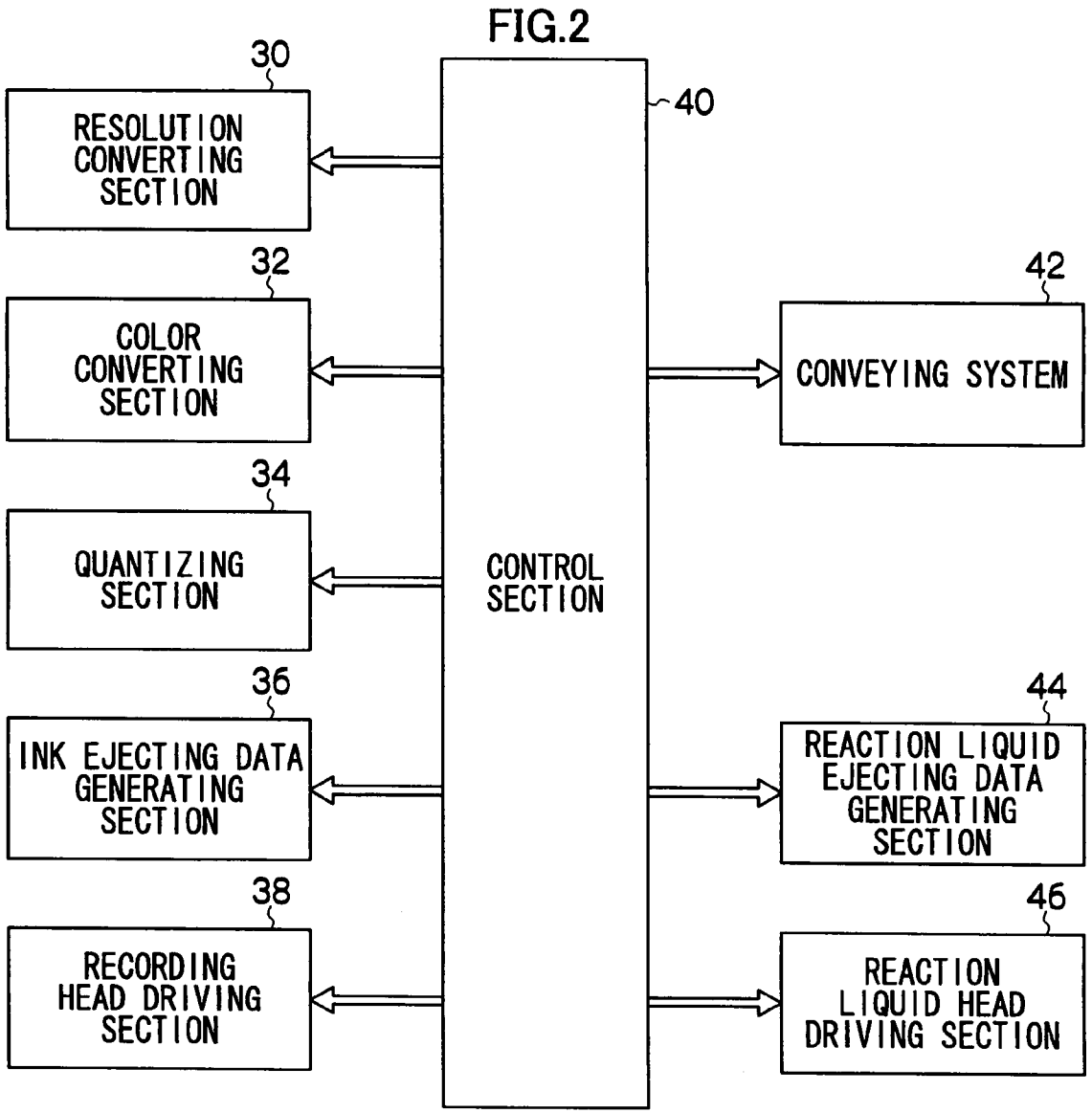
FIG. 2 is a block diagram showing the structure of a control system of the inkjet recording device.

FIG. 2 is a block diagram showing the structure of a control system of the inkjet recording device 10 relating to the present embodiment. As shown in FIG. 2, the inkjet recording device 10 has a resolution converting section 30 which, when image data is inputted from the exterior, converts that image data into image data of a resolution which can be outputted at the inkjet recording device 10. A color converting section 32 is connected to the resolution converting section 30. The color converting section 32 carries out color converting processing and density converting processing corresponding to the characteristics of the sheet P and the inks, on the image data which has been processed at the resolution converting section 30. The processing carried out by the color converting section 32 is usually carried out in accordance with a color (density) conversion table. The color (density) conversion table is prepared separately and stored, such that the characteristics of the color (density) expressed by the image data and the characteristics of the color (density) expressed at the inkjet recording device 10 accord with one another.

A quantizing section 34 is connected to the color converting section 32. The quantizing section 34 executes halftone processing on the image data processed at the color converting section 32. Here, because image data of 256 gradations is inputted, the quantizing section 34 converts the image data of the 256 gradations into image data of a number of gradations which can be controlled at a recording head driving section 38 which will be described later (i.e., a number of gradations which can be recorded at the inkjet recording device 10). For example, if recording in two gradations which are "no ink drop/ink drop" is possible at the inkjet recording device 10, binary halftone processing is carried out. If recording in four gradations which are "no ink drop/small drop/medium drop/large drop" is possible, four-value halftone processing is carried out. The halftone processing is carried out by known error diffusing processing or dither processing. Note that, in the present embodiment, description will be given by using as an example a case of recording in two gradations.

An ink ejecting data generating section 36 is connected to the quantizing section 34. The ink ejecting data generating section 36 converts the image data, which was processed at the quantizing section 34, into a data structure which can be recorded at the recording head driving section 38, rearranges the data in the order of recording (the order of transfer), and outputs it to the recording head driving section 38 as data for the ejecting of ink drops (ink ejecting data). At this time, the ink ejecting data is generated while also taking into consideration the data arrangement and the ejecting timing which is mapped to the arrangement of the recording heads 12K through 12Y and the nozzles 50A. The addition/insertion of various types of control signals is also carried out as needed.

The recording head driving section 38 is connected to the ink ejecting data generating section 36. The recording head driving section 38 causes ink drops to be ejected from the nozzles 50A of the liquid drop ejectors 50, by outputting driving signals of predetermined driving waveforms to the piezoelectric elements 50C of the respective liquid drop ejectors 50 of the recording heads 12K through 12Y in accordance with the ink ejecting data.

Further, a reaction liquid ejecting data generating section 44 is provided at the inkjet recording device 10.

The reaction liquid ejecting data generating section 44 generates reaction liquid ejecting data for ejecting reaction liquid, on the basis of the image data which is subjected to halftone processing at the quantizing section 34. In the same way as the ink ejecting data generating section 36, the reaction liquid ejecting data generating section 44 rearranges the generated reaction liquid ejecting data into the order of recording (order of transfer), and outputs it to a reaction liquid head driving section 46. The reaction liquid ejecting data generating section 44 also carries out the addition/insertion of various types of control signals as needed.

The reaction liquid head driving section 46 is connected to the reaction liquid ejecting data generating section 44. The reaction liquid head driving section 46 causes reaction liquid to be ejected from the nozzles 50A of the liquid drop ejectors 50, by outputting driving signals of predetermined driving waveforms to the piezoelectric elements 50C of the respective liquid drop ejectors 50 of the reaction liquid head 12L in accordance with the reaction liquid ejecting data.

A control section 40 is connected to the color converting section 32, the quantizing section 34, the ink ejecting data generating section 36, the recording head driving section 38, the reaction liquid ejecting data generating section 44, and the reaction liquid head driving section 46, and controls these sections.

While the control section 40 controls a conveying system 42 and conveys a sheet by the conveying body 24, the recording head driving section 38 drives the liquid drop ejectors 50 of the recording heads 12K through 12Y on the basis of the ink ejecting data generated by the ink ejecting data generating section 36 so as to cause ink drops to be ejected, and the reaction liquid head driving section 46 drives the liquid drop ejectors 50 of the reaction liquid head 12L on the basis of the reaction liquid ejecting data generated by the reaction liquid ejecting data generating section 44 so as to cause reaction liquid drops to be ejected, and an image is formed.

Next, the flow of processing for generating the ink drop ejecting data and the reaction liquid ejecting data at the inkjet recording device 10 will be described. Here, explanation will be given by using, as an example, a case of printing by one color among YMCK.

First, image data inputted from an external computer or the like is subjected to resolution conversion at the resolution converting section 30, and is subjected to color conversion and density conversion at the color converting section 32. The image data, which has been processed at the color converting section 32, is subjected to halftone processing at the quantizing section 34. In the present embodiment, image data of 256 gradations is converted into image data of recording level values of two gradations which are "no drop (0)/drop (255)". The image data which has been subjected to halftone processing in this way (hereinafter called "quantized data") is converted into ink ejecting data at the ink ejecting data generating section 36. In detail, first, the quantized data is converted into a data structure (e.g., no drop (0)/drop (1), or the like) which can be recorded at the recording head driving section 38. Thereafter, while taking the arrangement of the nozzles 50A into consideration, the recording order (transfer order) of the respective data is rearranged, and the ink ejecting data is generated.

The recording head driving section 38 applies, to the piezoelectric element 50C of each liquid drop ejector 50, voltage of a driving waveform corresponding to the ink ejecting data generated at the ink ejecting data generating section 36. Ink drops corresponding to the ink ejecting data are thereby ejected.

Figure 3:
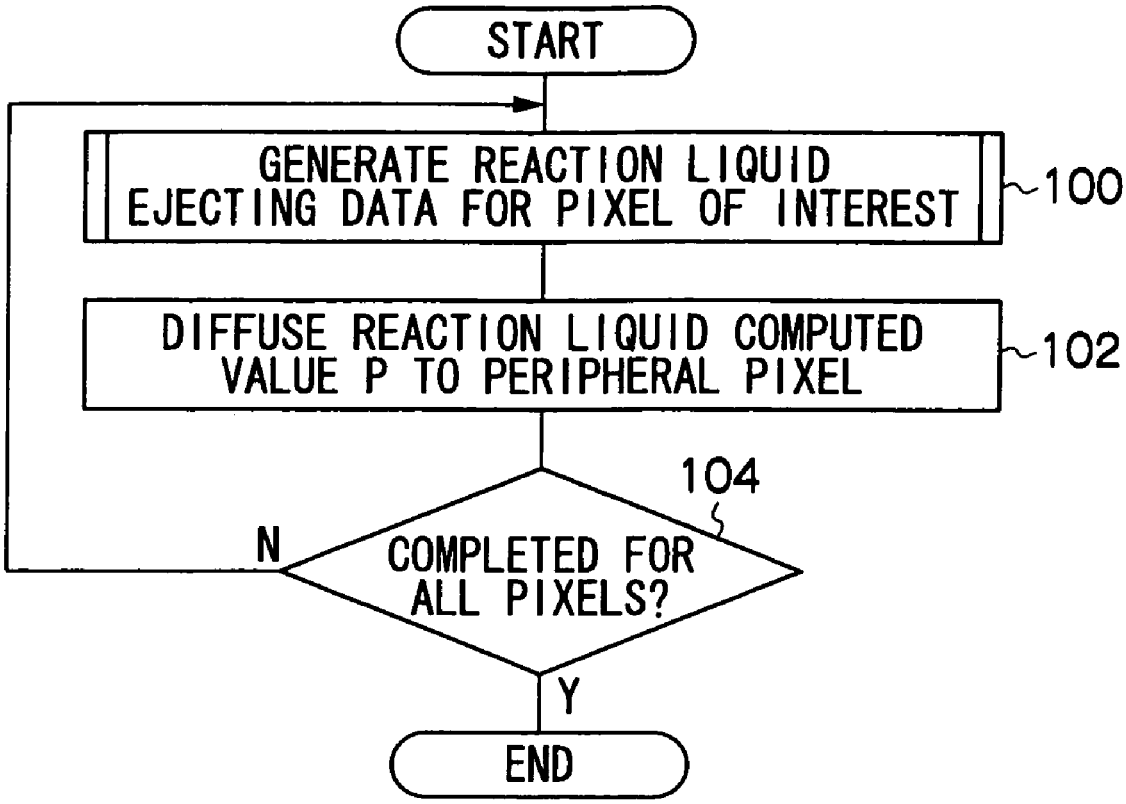
FIG. 3 is a flowchart of a processing routine (main routine) which is executed at a reaction liquid ejecting data generating section.

Next, the processing of generating the reaction liquid ejecting data will be described in detail. After the ink ejecting data is generated at the ink ejecting data generating section 36, the processing routine (main routine) shown in FIG. 3 is executed at the reaction liquid ejecting data generating section 44.

In step 100, a subroutine, which generates reaction liquid ejecting data for a pixel of interest, is carried out.

Figure 4:
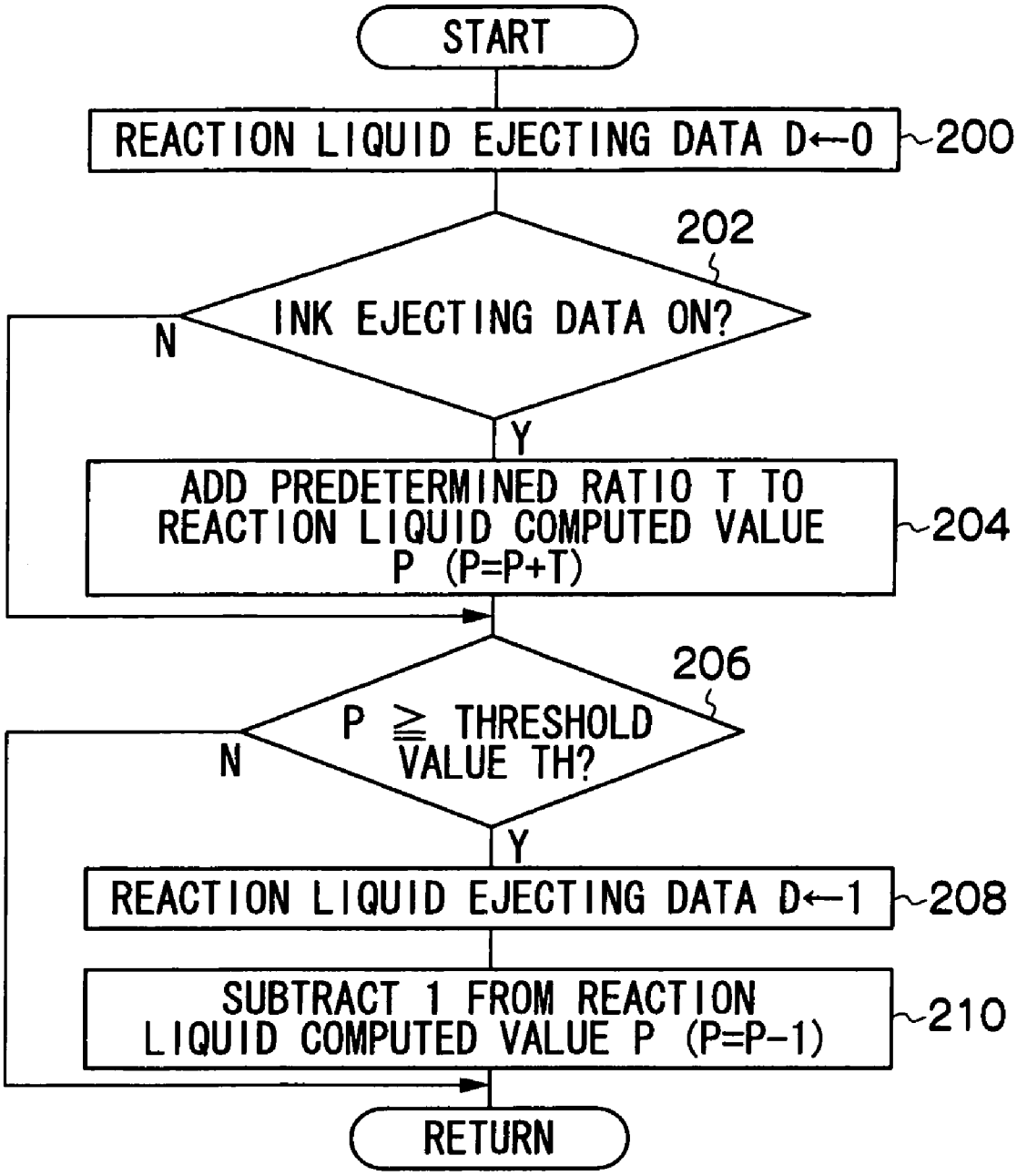
FIG. 4 is a flowchart showing a subroutine (data generating subroutine) which generates reaction liquid ejecting data for a pixel of interest.

FIG. 4 is a flowchart showing the subroutine (hereinafter called "data generating subroutine") which generates reaction liquid ejecting data for the pixel of interest.

In step 200, 0 (dot off: no drop) is set as the initial value of reaction liquid ejecting data D of a pixel of interest. In step 202, it is judged whether or not the ink ejecting data of the pixel of interest is on (drop: 1). If the ink ejecting data of the pixel of interest is on, in step 204, a ratio T of the reaction liquid amount to the ink amount, which ratio T is determined in advance, is added to a reaction liquid computed value P. As will be described later, an error, which was diffused from a peripheral pixel at the time when the reaction liquid ejecting data was generated previously for the pixel of interest, is set in advance at the reaction liquid computed value P (refer to step 102 of FIG. 3). The ratio T which is determined in advance is added to this reaction liquid computed value P. For example, in a case of carrying out ejecting with the reaction liquid amount being in a proportion of 0.2 with respect to an ink amount of 1, the ratio 0.2 is added to the reaction liquid computed value P.

After the processing of step 204, or if the judgment in step 202 is negative, the routine moves on to step 206.

In step 206, it is judged whether or not the reaction liquid computed value P is greater than or equal to a threshold value TH. Here, the threshold value is 1. If it is judged that the reaction liquid computed value P is greater than or equal to 1, in step 208, 1 (dot on: drop) is set as the reaction liquid ejecting data D of the pixel of interest. Namely, the reaction liquid ejecting data is generated such that a reaction liquid drop is ejected with respect to this pixel of interest. Next, in step 210, the value (1) of the generated reaction liquid ejecting data is subtracted from the reaction liquid computed value P, and processing returns to the main routine.

On the other hand, if it is judged in step 206 that the reaction liquid computed value P is less than 1, processing returns to the main routine without the processing of steps 208, 210 being carried out.

In the main routine of FIG. 3, when the data generating subroutine of step 100 ends, in step 102, the reaction liquid computed value P which was computed in the above-described subroutine, is diffused at a peripheral pixel. If the reaction liquid ejecting data is 1 as described above, a value obtained by subtracting 1 from the reaction liquid computed value P is diffused to a peripheral pixel as an error, whereas if the reaction liquid ejecting data is 0, the value of the reaction liquid computed value P is as is (this can also be called a value obtained by subtracting 0 from the reaction liquid computed value P) is diffused to a peripheral pixel as an error. Namely, the difference between the reaction liquid computed value P and the reaction liquid ejecting data is diffused to a peripheral pixel as an error. The diffused error is accumulated (set) to the reaction liquid computed value P of each pixel, and is used as is when the reaction liquid ejecting data is generated as the pixel of interest.

Note that the method of diffusing the error is not particularly limited. For example, the error may be diffused to the pixel which is adjacent to the right of the pixel of interest. Or, half of the error may be diffused to the pixel which is adjacent to the right of the pixel of interest, and the remaining half may be diffused to the pixel beneath.

In step 104, it is judged whether or not the generation of reaction liquid ejecting data is completed for all of the pixels. If the judgment here is negative, the routine returns to step 100, and the above-described data generating subroutine is executed by using the next pixel as the pixel of interest. Further, if the judgment in step 104 is affirmative, the present main routine ends.

Namely, in the present embodiment, when the ink ejecting data is on for the pixel of interest, a predetermined ratio (here, 0.2) is added to the reaction liquid computed value P, and when the ink ejecting data is off, nothing is added (or, zero is added) to the reaction liquid computed value P. The reaction liquid computed value P is carried over to a peripheral pixel until it becomes 1. At the point in time when the reaction liquid computed value P becomes equal to or greater than 1, ejecting data of that pixel is made to be on (1). Thereafter, 1 is subtracted from the reaction liquid computed value P. This processing is repeated for all of the pixels, and reaction liquid ejecting data is generated for all of the pixels. Accordingly, given that the predetermined ratio of the reaction liquid amount to the ink amount is 0.2, reaction liquid ejecting data, which is such that one dot of the reaction liquid is ejected with respect to 5 dots of the ink drops, is generated. Further, because the error at the time of generating the reaction liquid ejecting data is diffused, the reaction liquid drops are ejected without bias.

Figure 5A:
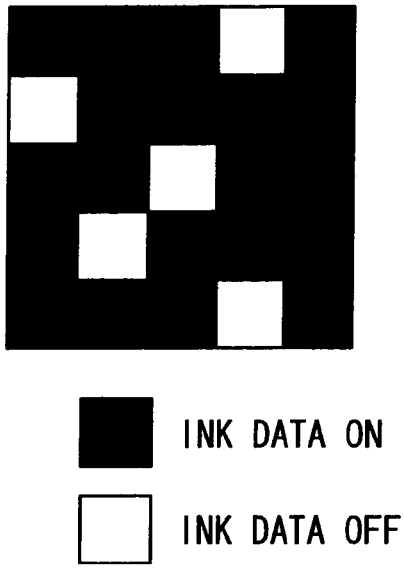
FIG. 5A is a diagram schematically showing an example of K color ink ejecting data for an image formed only by the color K.
Figure 5B:
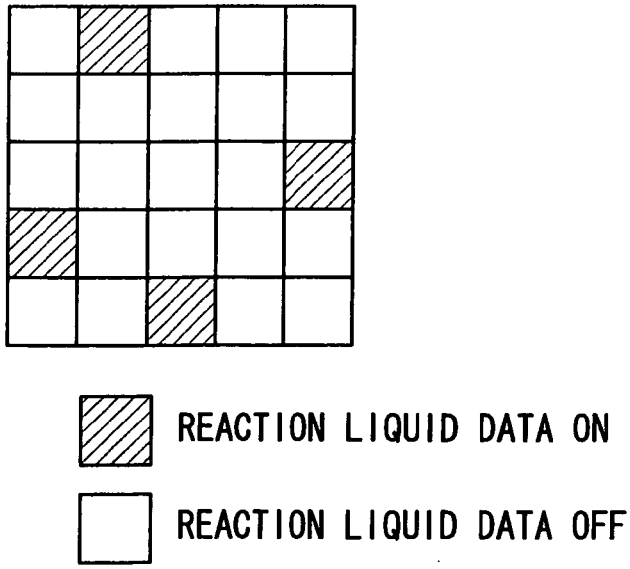
FIG. 5B is a diagram schematically showing an example of generated reaction liquid ejecting data.

A detailed example is shown in FIGS. 5A and 5B. FIG. 5A is a diagram schematically showing an example of ink ejecting data of K color for an image which is formed only in K color. Each square represents one pixel, and the pixels which are colored-in in black are dot-on (1) pixels, whereas the pixels which are shown as being white are dot-off (0) pixels. The predetermined ratio T is added to the reaction liquid computed value P at the dot-on pixels, and ultimately, reaction liquid ejecting data such that the reaction liquid drops are ejected as shown in FIG. 5B, can be generated.

As described above, the reaction liquid ejecting data which is for ejecting the reaction liquid drop is generated on the basis of the ink drop ejecting data of the pixel of interest, the error diffused from a peripheral pixel at the time when the reaction liquid ejecting data was generated previously for the pixel of interest, and the predetermined ratio of the reaction liquid amount to the ink amount. Therefore, the reaction liquid ejecting data can be generated such that the reaction liquid amount is optimal for the ink amount.

Further, because the ratio T is added to the reaction liquid computed value P in accordance with the ink ejecting data, the value of the reaction liquid computed value P does not change at pixels at which the ink ejecting data is off, and it is possible to make reaction liquid not be ejected at the pixels at which ink drops are not ejected, the reaction liquid drops can be reliably overlapped on the ink drops, and the reaction liquid can be ejected at the appropriate positions. Namely, the reaction liquid can be appropriately ejected in accordance with the image to be formed. Further, because the error is diffused, it is seldom the case that the regions at which there is reaction liquid data are dense, or conversely are sparse (it is seldom the case that the reaction liquid dots are biased). Further, by diffusing the error, effects of the ink ejecting data of the peripheral pixel also are received at the time of generating the reaction liquid ejecting data of the pixel of interest. Therefore, it is possible to avoid a situation in which reaction liquid is ejected needlessly at regions at which ejection of the reaction liquid is unnecessary.

Note that the ratio T which is determined in advance is not limited to the aforementioned 0.2, and can be changed depending on the case.

Further, the above explanation describes, as an example, a case of printing by using any one color among YMCK. However, the present invention is not limited to the same, and, for example, reaction liquid ejecting data can be generated as follows in the case of color printing.

Figure 6:
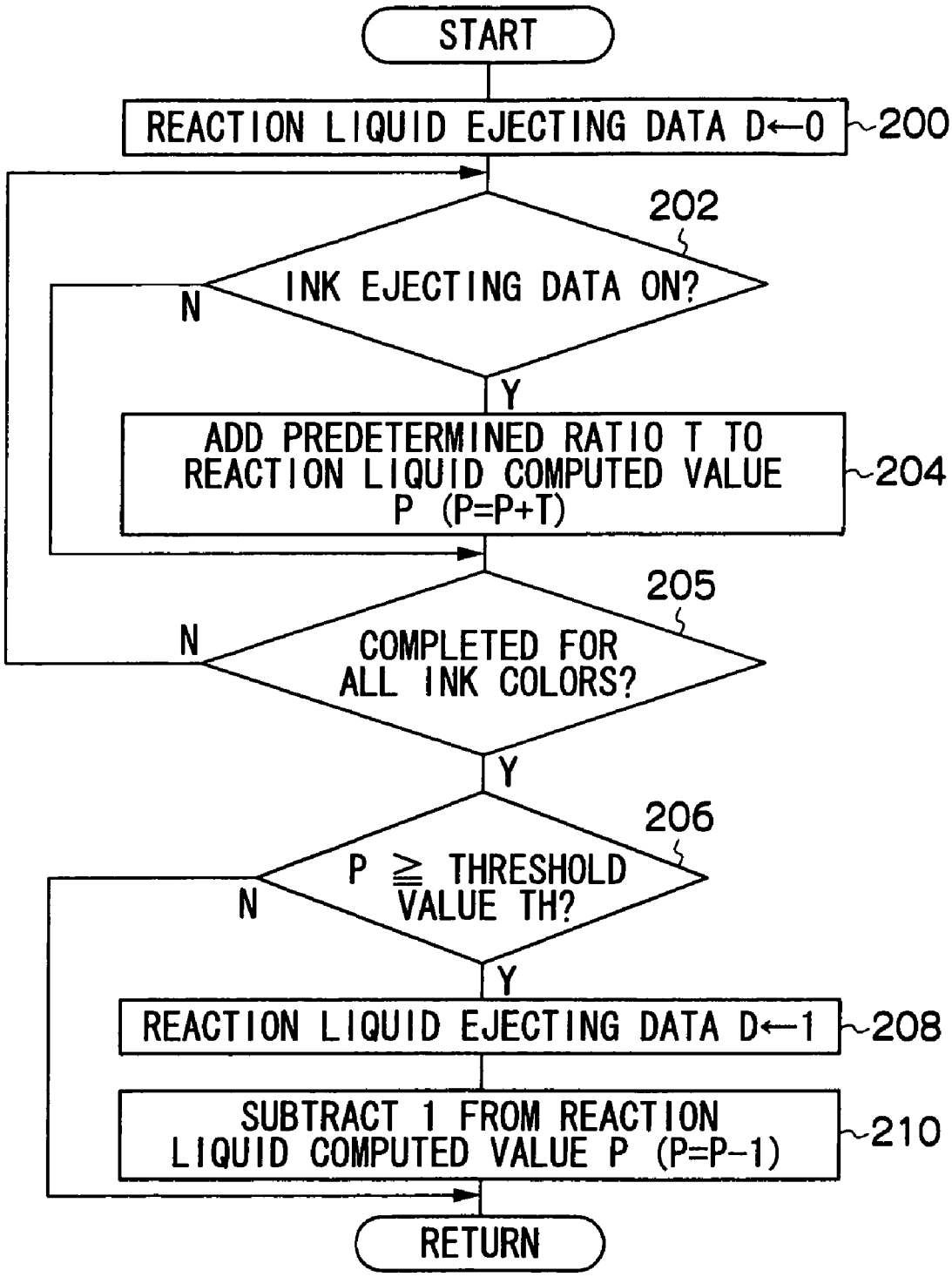
FIG. 6 is a flowchart showing a data generating subroutine at the time of generating reaction liquid ejecting data in a case of color printing.

FIG. 6 is a flowchart showing a data generating subroutine at the time of generating reaction liquid ejecting data in the case of color printing. Note that, in FIG. 6, steps carrying out the same processing as in FIG. 4 are denoted by the same step numbers as in FIG. 4, and description thereof will be omitted.

In a case in which the ink ejecting data is off (0) in step 202, or in a case in which the ink ejecting data is on (1) in step 202 and the processing of step 204 of adding the ratio T is completed, the routine moves on to step 205 where it is judged whether or not the processing of steps 202 through 204 are completed for all of the ink colors (all of YMCK). Here, if it is judged that processing are not completed for all of the colors of YMCK, the routine returns to step 202, and the processing of step 202 through 204 are repeated. In this way, the predetermined ratio T of the reaction liquid amount to the ink amount is added to the reaction liquid computed value P in accordance with the on or off state of the ink ejecting data of each color. For example, in a case in which the predetermined ratio T is 0.2 and ink ejecting data of the three colors of YMC are on (a case in which ink drops of these colors are overlapped on one pixel), 0.6 is added to the reaction liquid computed value P. In this example, reaction liquid of an amount which is twice that of the first color is ejected in the case of the second color, and reaction liquid of an amount which is three times that of the first color is ejected in the case of the third color.

The processing from step 206 through step 210 are similar to the processing in the above-described case of single color printing.

In this way, in the case of color printing, because the reaction liquid ejecting data is generated by adding the ratio T in accordance with the respective ink ejecting data of YMCK, an optimal amount of reaction liquid can be ejected in accordance with the ink amount.

Note that the ratio T of the reaction liquid amount to the ink amount may be changed in accordance with the color of the ink. For example, the ratio T may be made to be different for color K, at which it is desired to improve the image density and reduce blurring, and for color Y at which blurring is not conspicuous and at which the human eye sensibility is less. For example, the ratios can be changed such that the ratio is 0.3 for the color K, 0.2 for the colors C and M, and 0.1 for the color Y In this case, each time that the ink ejecting data of the respective colors are on, the values thereof are added to the reaction liquid computed value P.

Further, the ratio of the reaction liquid amount to the ink amount can be changed by the dot appearing ratio of the ink ejecting data, or the like. For example, the needed amount of reaction liquid differs at highlight regions (regions where the ink dots are sparse) and high density regions (regions where the ink dots are dense). Accordingly, the reaction liquid ejecting data is generated so as to as much as possible not discharge reaction liquid at the highlight regions.

In detail, the ratio T of the reaction liquid amount to the ink amount is determined in accordance with the image data before halftone processing. For example, a relationship table such as that shown in FIG. 7, which prescribes the relationships between the image data of 256 gradations before halftone processing and the ratio T of the reaction liquid amount to the ink amount, is set in advance. As shown in FIG. 7, the values of the ratio T corresponding to image data of low gradation values are set to be low, whereas the values of the ratio T corresponding to image data of high gradation values are set to be large.

When the ratio T is added to the reaction liquid computed value P (i.e., at the time of the above-described processing of step 204), the ratio T corresponding to the image data before halftone processing of the pixel of interest is read-out from such a relationship table. Then, the read-out ratio T is added to the reaction liquid computed value P. In this way, in a low-gradation highlight region, even if the ink ejecting data after the halftone processing is on, it is difficult for the reaction liquid ejecting data to become on, and therefore, it is possible to avoid the reaction liquid being ejected wastefully.

Further, the above-described embodiment describes, as an example, a case in which the numbers of gradations which can be recorded at the inkjet recording device 10 are the two gradations of "no dot/dot". However, the inkjet recording device 10 may be a device which can record in multiple gradations, e.g., a device which can record by changing the dot diameter of the ink drop (the drop amount) to a small drop and a large drop.

In detail, by controlling the driving waveform applied to the piezoelectric element 50C as shown in FIGS. 8A and 8C, it is possible to eject, for example, a large ink drop (see FIG. 8B) and a small ink drop (see FIG. 8D) from the nozzle 50A. In a case in which no ink drop or reaction liquid is to be ejected from the nozzle 50A (no drop), voltage of a waveform which is such that no dot is formed is applied.

In this way, in a case in which the dot diameter of the ink drop (the dot amount), i.e., the type of the ink drop, can be made to differ, the ratio T of the reaction liquid amount can be changed in accordance with the type of the ink drop.

For example, in the case of recording in three gradations which are no drop/small drop/large drop, if reaction liquid is made to be not ejected at the time when the type of the ink drop is small drop, the ratio T at the time when the ink drop type is small drop can be made to be 0, and the ratio T at the time of a large drop can be made to be 0.2.

In this case, processing such as follows are carried out in the data generating subroutine shown in above-described FIG. 4 or FIG. 6. First, in step 202, when it is judged whether or not the ink ejecting data of the pixel of interest is on, the ink ejecting data is judged to be on in a case in which the ink ejecting data expresses "small drop" or "large drop", and is judged to be off in a case in which the ink ejecting data expresses "no drop". Further, when it is judged that the ink ejecting data is on, in step 204, the ratio T corresponding to the type of the ink drop (0 in the case of a small drop, 0.2 in the case of a large drop) is added to the reaction liquid computed value P. Processing from thereon are carried out in the same way as in above-described FIG. 4 and FIG. 6, and therefore, description thereof will be omitted.

Moreover, the vision characteristics of humans are such that it is difficult to discern the density of the color Y. Therefore, the reaction liquid ejecting data may be generated such that no reaction liquid drops are ejected at pixels which are formed in the single color of Y color.

Figure 9:
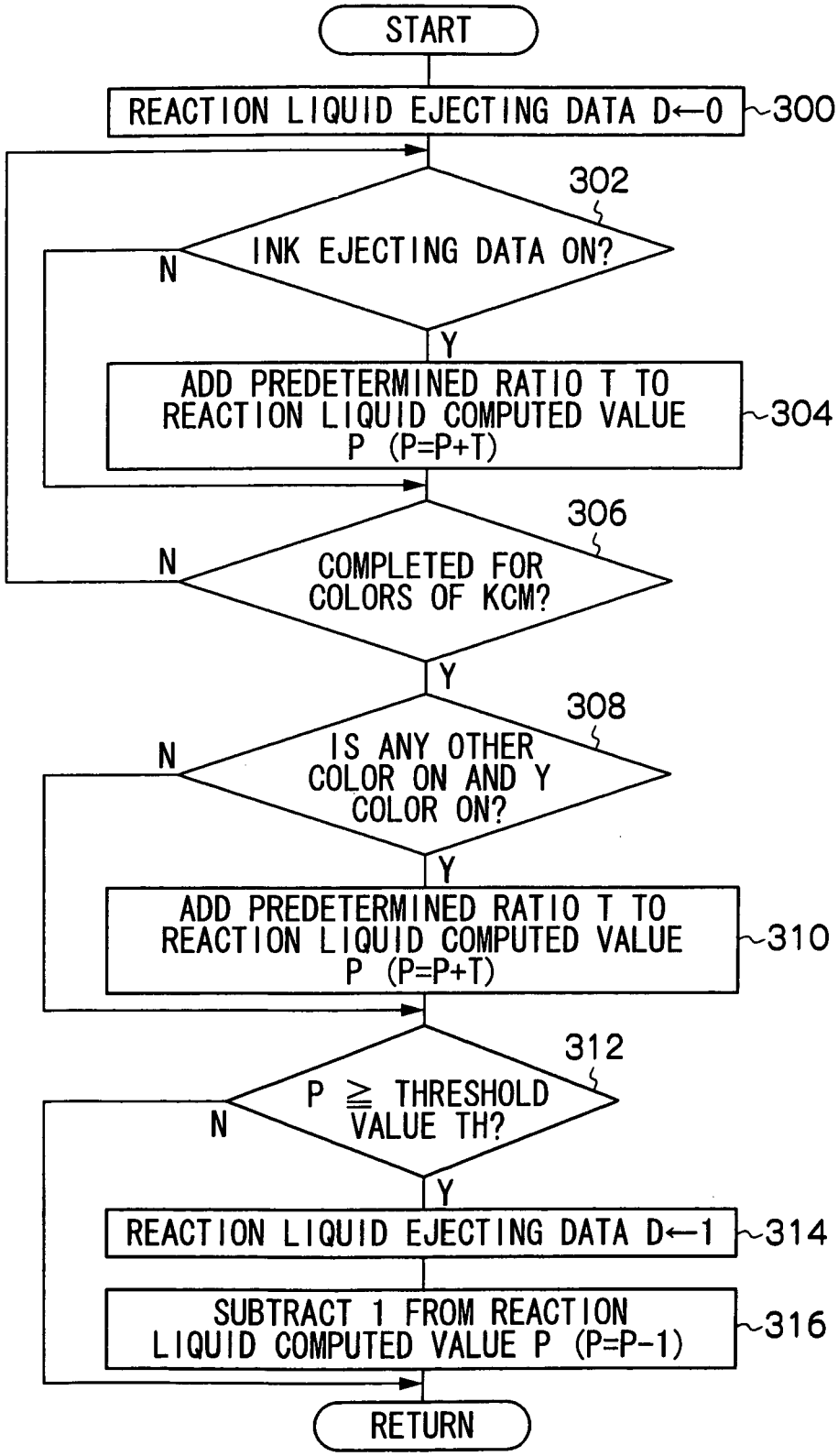
FIG. 9 is a flowchart showing a data generating subroutine in a case in which reaction liquid ejecting data is generated such that reaction liquid is not ejected at pixels formed only by the color Y.

FIG. 9 is a flowchart showing a data generating subroutine in a case of generating reaction liquid ejecting data such that reaction liquid is not ejected at pixels which are formed by the single color of Y color.

Description of the processing of step 300 to step 304 will be omitted as they are similar to the processing of step 200 through step 204 in the case of color printing in FIG. 6, except that they are carried out for the colors of KCM and excluding the color Y.

In step 306, it is judged whether or not the processing of steps 302 through 304 are completed for all of the colors of KCM excluding the color Y Here, if it is judged that processing are not finished for all of the colors of KCM, the routine returns to step 302, and the processing of steps 302 through 304 are repeated. Further, if it is judged that processing are completed for all of the colors of KCM, in step 308, it is judged whether or not the ink ejecting data of Y color is on and the ink ejecting data of at least one color among the colors other than Y color is on. For example, in a case in which Y and another color are to be overlapped (a case of forming green by Y+C, or the like), the judgment is affirmative. Further, if the ink ejecting data of all of the colors of KCM are off or the ink ejecting data of Y color is off, the judgment is negative.

If the judgment in step 308 is affirmative, in step 310, the predetermined ratio T is added to the reaction liquid computed value P.

After the processing of step 310, or if the judgment in step 308 is negative, the routine moves on to step 312. Because the processing of step 312 through step 316 are similar to the processing of step 206 through step 210 of FIG. 4 and FIG. 6, description thereof will be omitted.

By carrying out processing in this way, it is possible to generate reaction liquid ejecting data such that a reaction liquid drop is not ejected at a pixel formed by the single color of Y color.

Moreover, the ratio T may be changed in accordance with the number of colors of inks which are overlapped (the first color, the second color, the third color).

Figure 10:
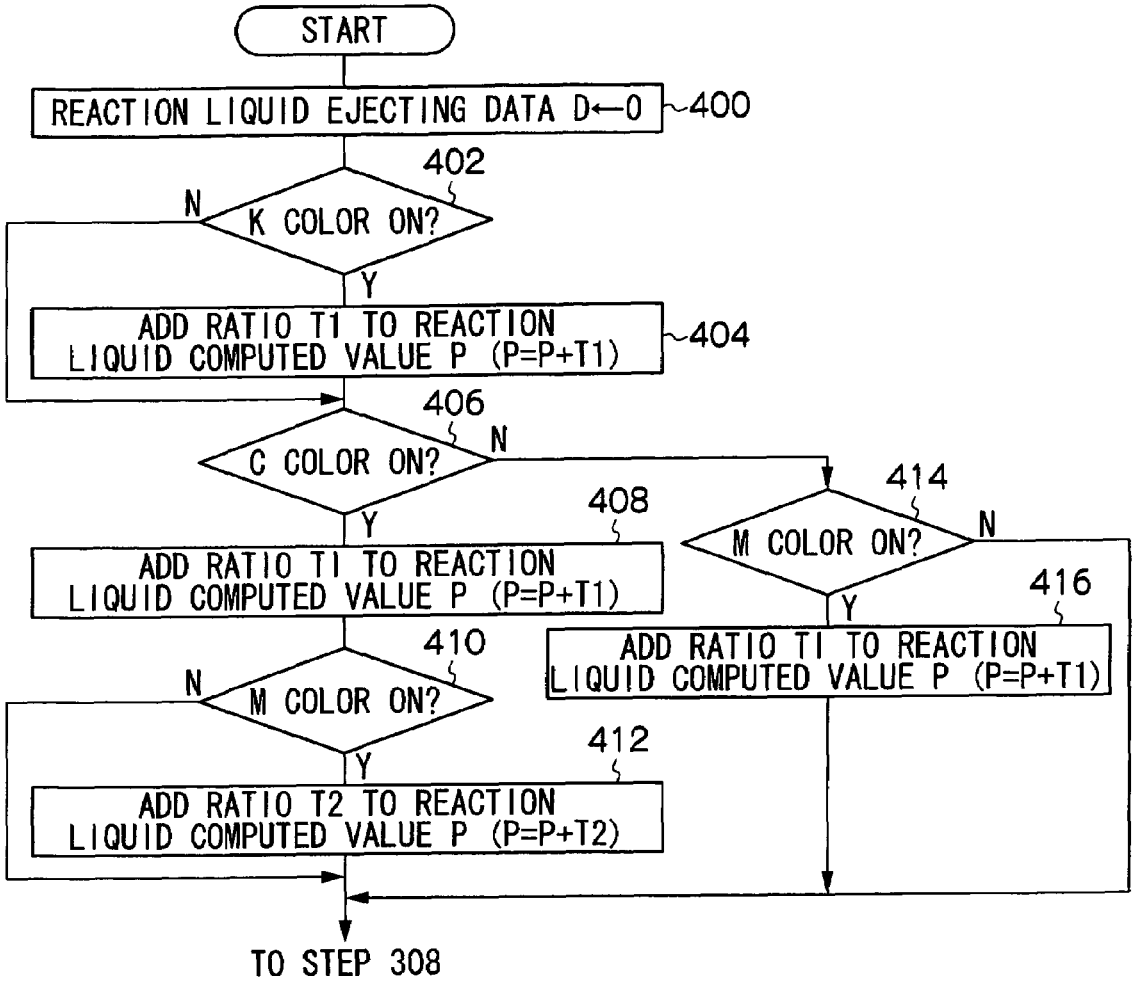
FIG. 10 is a flowchart showing a data generating subroutine in a case of changing a ratio to be added, in accordance with the number of colors of inks which are superposed.

FIG. 10 is a flowchart showing a data generating subroutine in the case of changing the ratio which is to be added, in accordance with the number of colors of inks which are overlapped. Here, the reaction liquid computed value P is computed by using two different ratios T1 (0.2) and T2 (0.1) such that, in the case of the second color, the reaction liquid amount is 1.5 times that of the first color.

In step 400, 0 (dot off: no drop) is set as the initial value at the reaction liquid ejecting data D for the pixel of interest. In step 402, it is judged whether or not the ink ejecting data of color K of the pixel of interest is on (drop: 1). Here, if the ink ejecting data of color K of the pixel of interest is judged to be on, in step 404, the ratio T1 (0.2) is added to the reaction liquid computed value P.

After the processing of step 404, or if the judgment in step 402 is negative, the routine moves on to step 406.

In step 406, it is judged whether or not the ink ejecting data of color C of the pixel of interest is on. Here, if the ink ejecting data of color C of the pixel of interest is judged to be on, in step 408, the ratio T1 (0.2) is added to the reaction liquid computed value P. Next, in step 410, it is judged whether or not the ink ejecting data of color M of the pixel of interest is on. Here, if the ink ejecting data of color M of the pixel of interest is judged to be on, this pixel of interest is to be formed by overlapping at least color C and color M. Therefore, in step 412, the ratio T2 (0.1), which is smaller than the ratio T1, is added to the reaction liquid computed value P.

On the other hand, if it is judged in step 406 that the ink ejecting data of C color of the pixel of interest is not on, the routine moves on to step 414. In step 414, it is judged whether or not the ink ejecting data of color M of the pixel of interest is on. Here, if the ink ejecting data of color M of the pixel of interest is judged to be on, in step 416, the ratio T1 (0.2) is added to the reaction liquid computed value P.

Note that, if the judgments of step 410 and step 414 are negative, or, after the processing of step 412 or step 416, processing which are similar to those of step 308 through step 316 of FIG. 9 are carried out. Note that, the ratio which is added to the reaction liquid computed value P in step 310 can be made to be the ratio T2 which is smaller than the ratio T1.

Accordingly, in this example, in the case of the single color of Y color, nothing is added to the reaction liquid computed value P. In the case of a single color of C color or M color, 0.2 (i.e., T1) is added to the reaction liquid computed value P. In the case of a second color, 0.3 (i.e., T1+T2) is added to the reaction liquid computed value P. In the case of a third color, 0.4 (i.e., T1+2×T2) is added to the reaction liquid computed value P.

Note that, with regard to the color K, it is usual to form pixels in the single color of K color, and K is not used by being overlapped together with the colors of CMY. Therefore, here, overlapping of the color K and the colors of CMY is not considered.

The present invention is not limited to the above described exemplary embodiment. For example, regardless of the type of colors, the ratio T1 for the first color may be added to the reaction liquid computed value, the ratio T2 (T2<T1) for the second color may be added to the same, the ratio T3 (T3<T2) for the third color may be added to the same, and so on.

Figure 11A:
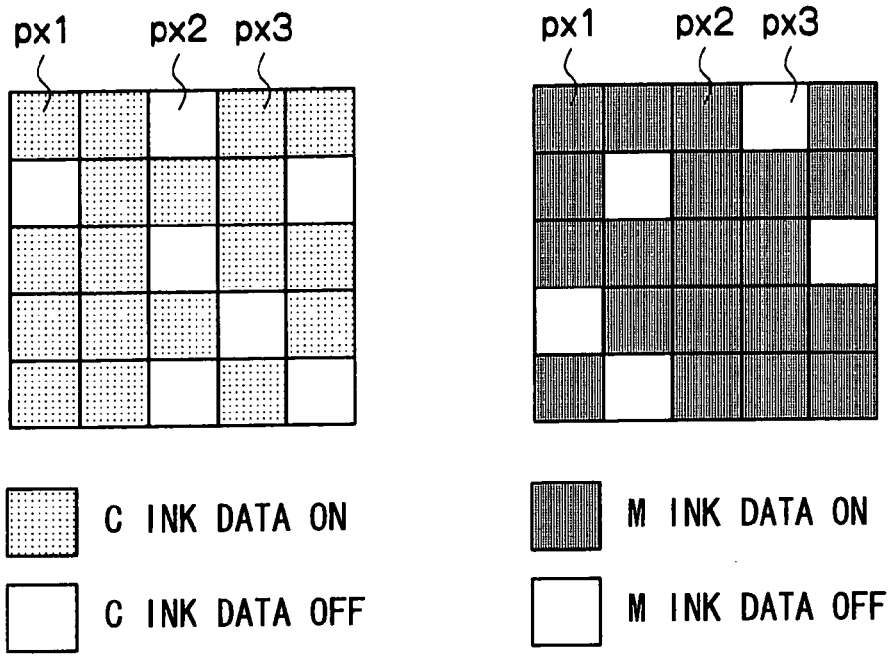
FIG. 11A is a diagram schematically showing an example of ink ejecting data of the color C and ink ejecting data of the color M, for an image formed by the two colors of C and M.
Figure 11B:
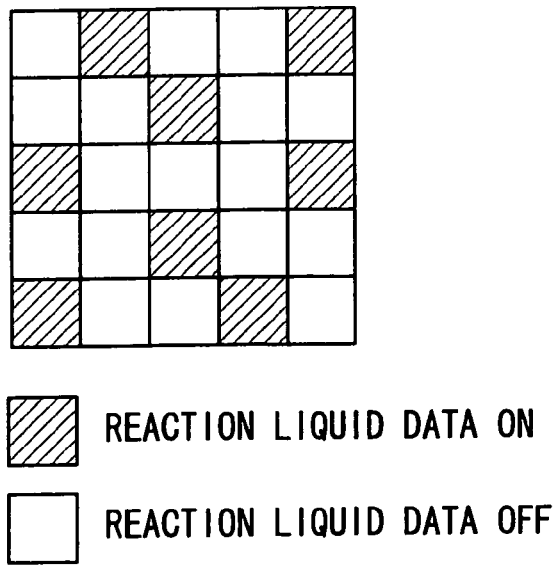
FIG. 11B is a diagram schematically showing an example of generated reaction liquid ejecting data.

A detailed example is shown in FIGS. 11A and 11B. FIG. 11A schematically shows an example of ink ejecting data of C color and ink ejecting data of M color for an image formed by the two colors of C and M. Each square represents one pixel, and the pixels which are colored-in darkly are dot-on (1) pixels, whereas the pixels which are shown as being white are dot-off (0) pixels. At pixel px1, because both the color C and the color M are on, 0.3 is added to the reaction liquid computed value P. At pixel px2, only M color is on, and at pixel px3, only C color is on, and therefore, 0.2 is added. Finally, reaction liquid ejecting data, by which the reaction liquid drops are ejected as shown in FIG. 11B, can be generated.

In this way, the reaction liquid ejecting data is generated by changing the ratio to be added, in accordance with the numbers of colors of inks to be overlapped. Therefore, the reaction liquid drops can be ejected in optimal amounts.

For example, by merely computing the logical sum as was the case conventionally, the amount of the reaction liquid would be the same for both the first color and the second color. However, by carrying out processing as described above, the amount of the reaction liquid can be made to be different at the first color and at the second color. Moreover, even in cases in which the reaction liquid amounts needed at the second color and the third color are not merely twice that and thrice that of the first color, the reaction liquid can be ejected at optimal amounts by adjusting the ratio added to the reaction liquid computed value P at the first color, the second color, and the third color as described above. In this way, more reaction liquid than needed is not consumed, costs can be kept down, and wrinkling of the sheet also can be suppressed.

Figure 12:
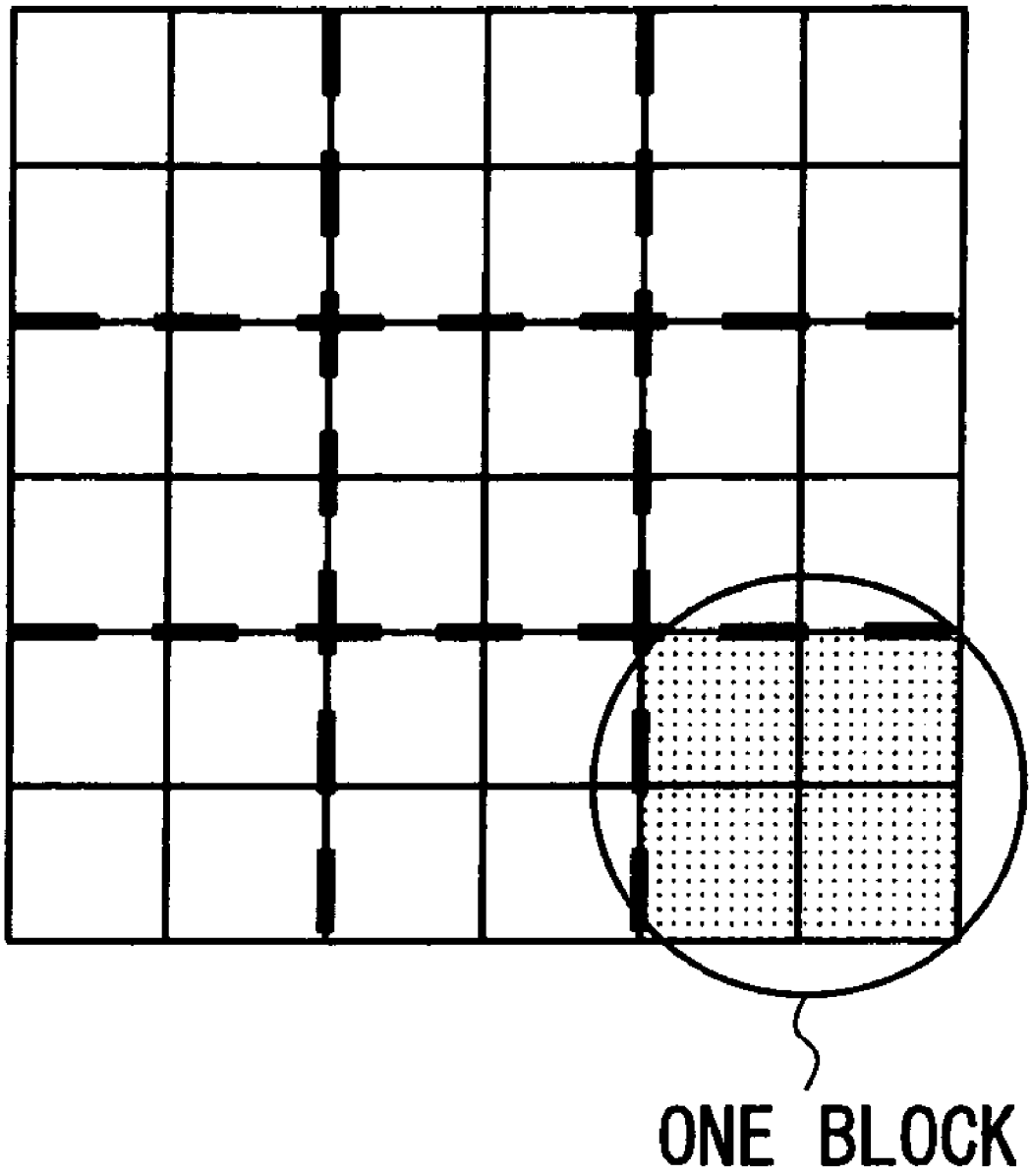
FIG. 12 is a diagram explaining a divided state at a time of dividing an image into a plurality of blocks, where one block is N×M pixels.

Further, in the above-described embodiment, explanation is given of an example in which the error (the difference between the reaction liquid computed value P and the reaction liquid ejecting data), which arises at the time when the reaction liquid ejecting data is generated, is diffused in units of pixels at a peripheral pixel. However, the present invention is not limited to the same. For example, as shown in FIG. 12, the image can be divided into plural blocks with each one block being N×M pixels (in FIG. 12, 2×2 pixels), and the error can be diffused in units of these blocks.

Figure 13:
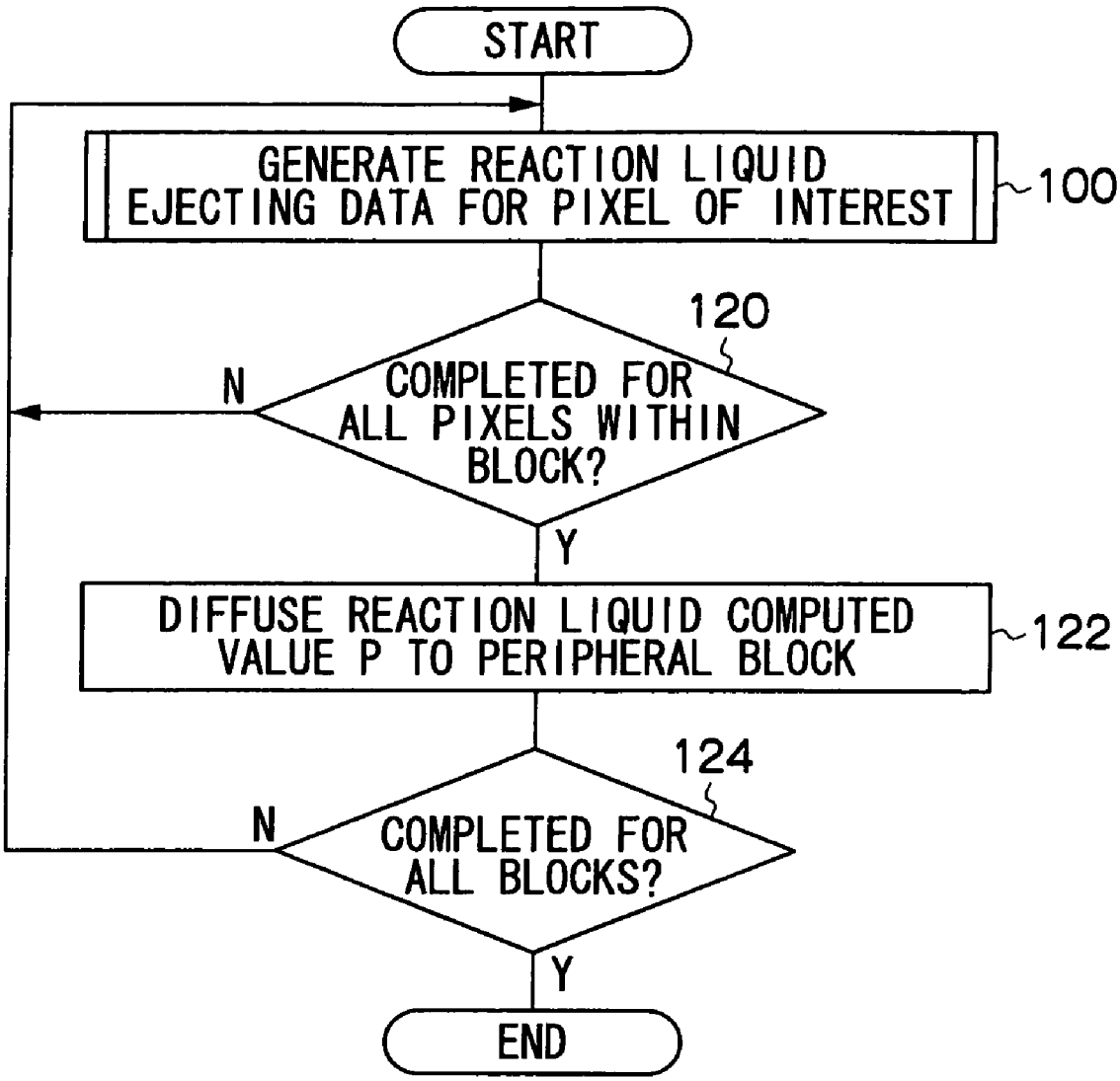
FIG. 13 is a flowchart showing a main routine executed at the reaction liquid ejecting data generating section in a case in which an error is diffused in block units.

FIG. 13 is a flowchart showing a main routine executed at the reaction liquid ejecting data generating section 44 in a case in which the error is diffused in block units. Here, the block which is undergoing processing is called the block of interest, and the block at the periphery to which the error is diffused from the block of interest is called a peripheral block.

In step 100, the data generating subroutine is executed as described above. In step 120, it is judged whether or not generation of reaction liquid ejecting data is completed for all of the pixels within the block of interest. Here, if it is judged that the reaction liquid ejecting data generating processing is not completed for all of the pixels, the routine returns to step 100, and the data generating subroutine is carried out by using the next pixel within the block of interest as the pixel of interest. Further, when it is judged that the reaction liquid ejecting data generating processing has been completed for all of the pixels within the block of interest, the routine moves on to step 122 where the reaction liquid computed value P of the block of interest is diffused to the respective pixels of a peripheral block. Here, a value, which is obtained by the cumulative value of the reaction liquid computed values P (errors) of the respective pixels within the block of interest being divided by the number of pixels structuring a single block, is diffused to the reaction liquid computed values P of the respective pixels of the peripheral block.

In step 124, it is judged whether or not the generation of reaction liquid ejecting data is completed for all of the blocks. If the judgment here is negative, the routine returns to step 100, and the above-described data generating subroutine is executed by using the pixels of the next block as the pixels of interest. Further, if the judgment in step 124 is affirmative, generation of reaction liquid ejecting data for all of the blocks is completed, and therefore, the present main routine ends.

Such error diffusion in block units is effective in cases in which it is desired to diffuse the reaction liquid drops in patches over the entire image.

Further, the ratio of the reaction liquid amount to the ink amount may be changed in accordance with the positions of the pixels. For example, in a case in which the liquid drop ejector 50 whose ejecting characteristic is poor is included among the recording heads 12Y through 12K, for pixels of the image region at which ink drops are ejected by this liquid drop ejector 50 whose ejecting characteristic is poor, the ejecting ratio of the reaction liquid can be made to be different than that at other portions.

Note that the relationship between the pixel position and the ratio may be set in advance in a relationship table, and the appropriate ratio T can be added to the reaction liquid computed value P by referring to this relationship table. Further, the ratio T can be changed per individual pixel, or the ratio T can be changed in block units.

Figure 14:
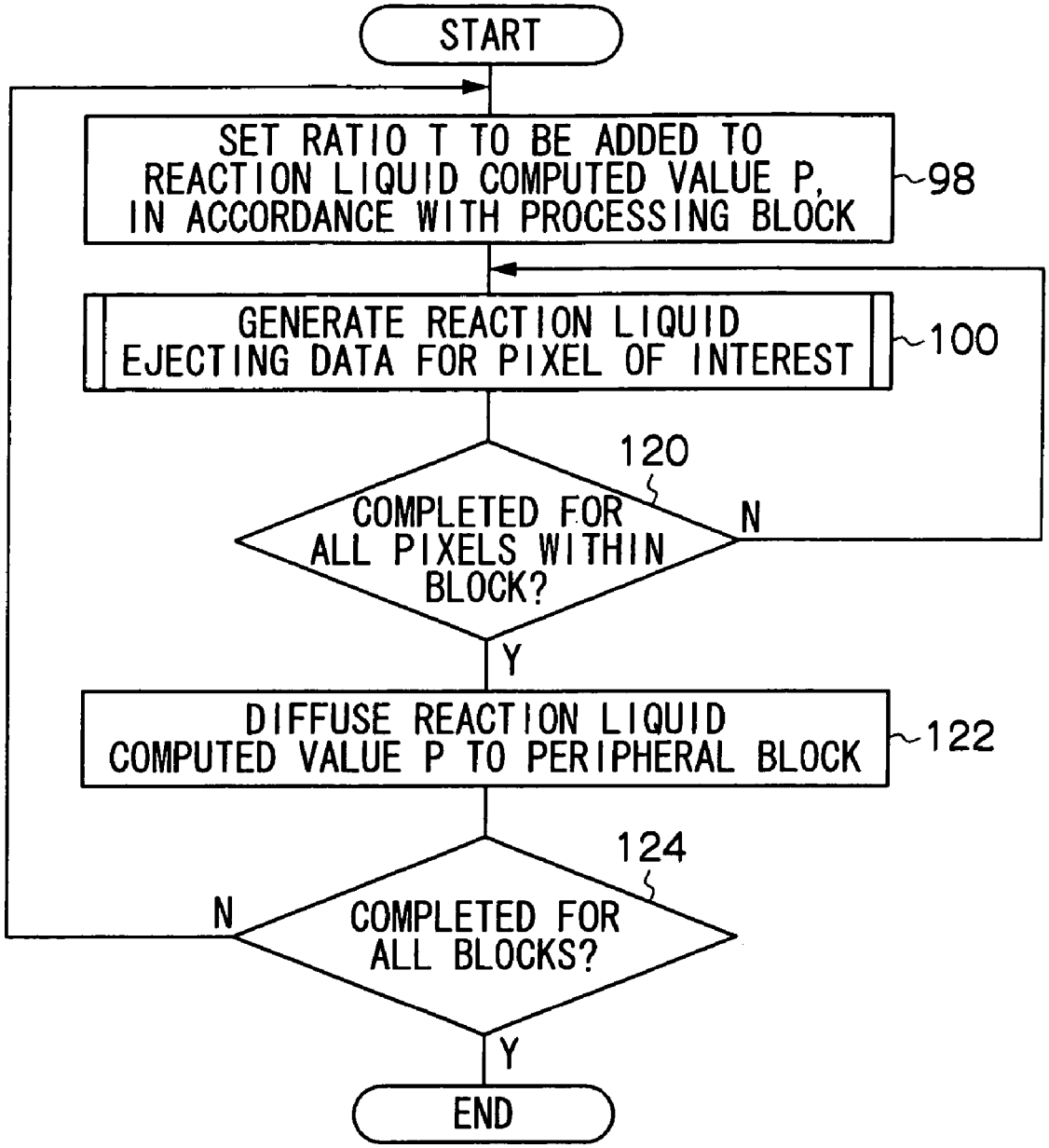
FIG. 14 is a flowchart showing a main routine executed at the reaction liquid ejecting data generating section in a case in which the ratio is changed in accordance with the position of a block.

FIG. 14 is a flowchart showing a main routine which is executed at the reaction liquid ejecting data generating section 44 in a case in which the ratio is changed in accordance with the position of the block.

In step 98, the ratio T of the reaction liquid amount to the ink amount is set in accordance with the position of the block which is the object of processing. For example, in regions using reaction liquid, the ratio T can be set to 0.2, and in regions using a reduced amount of reaction liquid, the ratio T can be set to 0.1, and in regions not using any reaction liquid at all, the ratio T can be set to 0.

The processing from step 100 to step 124 are the same processing as step 100 to step 124 of previously-described FIG. 13, and therefore, description thereof will be omitted. However, in the data generating subroutine of step 100, the ratio which is set in step 98 is used as the ratio T which is added to the reaction liquid computed value P.

In this way, the ratio T of the reaction liquid amount to the ink amount can be changed in accordance with the pixel position. Accordingly, controlling the reaction liquid ejecting ratio in accordance with the position within the image controls blurring of the inks, and is effective as a countermeasure to banding for making stripes (banding) less conspicuous, or the like.

Further, the ratio of the reaction liquid amount to the ink amount may be changed in accordance with the type of the sheet or the output mode which is the output speed. For example, for sheets at which it is easy for inks to spread, the ratio T can be changed so as to be made higher, whereas, for sheets at which it is difficult for inks to spread, the ratio T can be changed so as to be made lower.

Note that the above describes, as an example, changing the ratio T in accordance with any of the image data before halftone processing which is used in order to generate the ink ejecting data, the color of the ink, the type of the ink drop, the number of colors of inks needed in order to form the pixel of interest, the pixel position, and the output mode. However, the ratio T may be changed in accordance with a combination of a plurality of these.

The above embodiment describes an example of inputting image data, generating ink ejecting data and reaction liquid ejecting data within the inkjet recording device on the basis of the inputted image data, and driving the liquid drop ejectors in accordance with these data so as to carry out recording. However, the present invention is not limited to the same. For example, the ink ejecting data and the reaction liquid ejecting data may be generated at an external device, and the inkjet recording device may drive the liquid drop ejectors and carry out recording on the basis of the ink ejecting data and the reaction liquid ejecting data generated at the external device.

Figure 15:
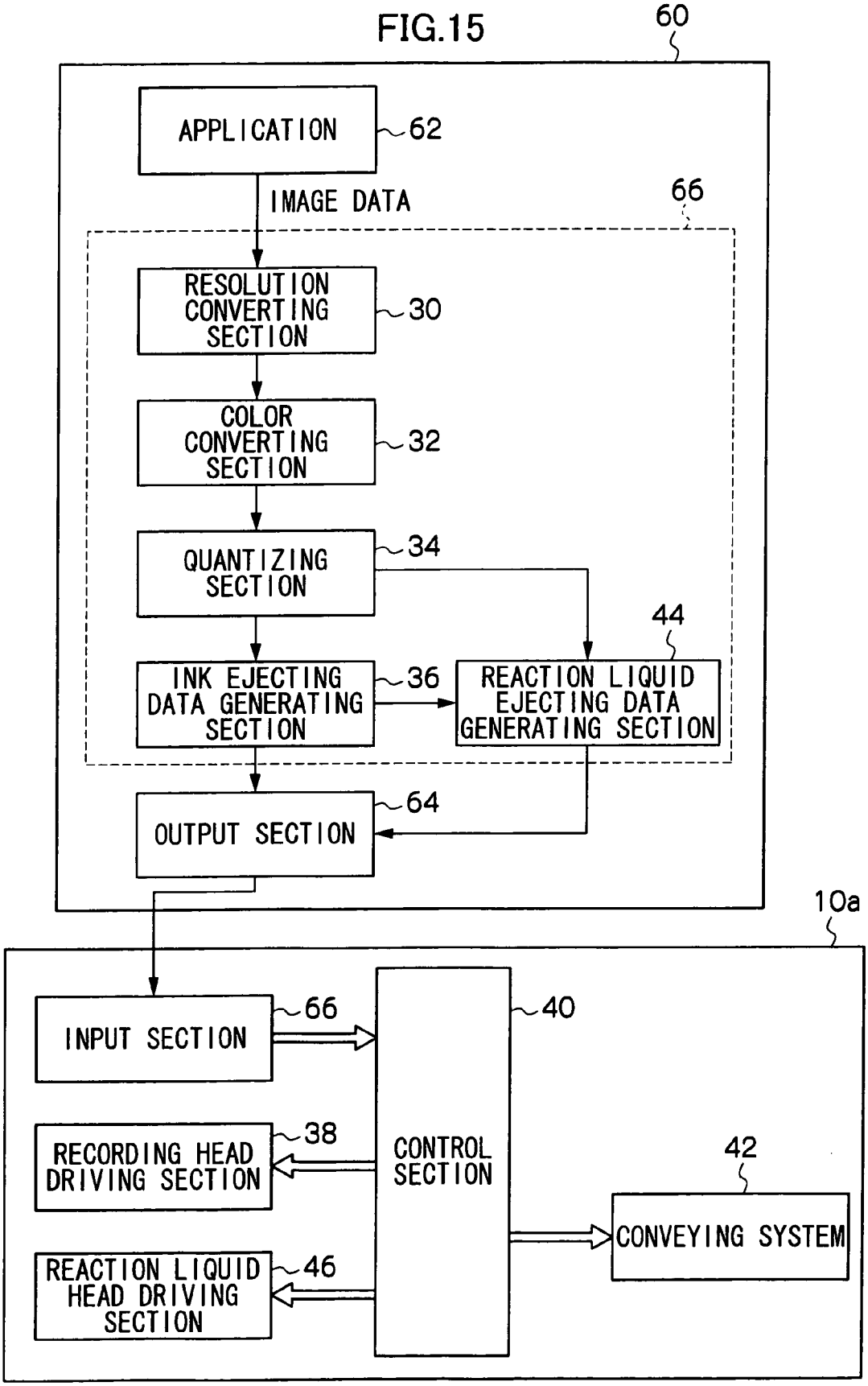
FIG. 15 is a block diagram showing the structure of a control section of a personal computer and an inkjet recording device in a modified example.

In detail, a structure such as shown in FIG. 15 may be employed. An application 62 which generates image data; a printer driver 66 equipped with the above-described resolution converting section 30, color converting section 32, quantizing section 34, ink ejecting data generating section 36, and reaction liquid ejecting data generating section 44; and an output section 64 which is an interface with an inkjet recording device 10*a*, are provided at a personal computer (PC) 60 serving as an external device. An input section 66 which is an interface with the PC 60, the control section 40, the recording head driving section 38, the reaction liquid head driving section 46, and the conveying system 42 are provided at the inkjet recording device 10*a*.

This structure operates in the same way as the above-described embodiment, except for the point that the processing generating the ink ejecting data and the reaction liquid ejecting data are carried out at the PC 60. Therefore, this structure exhibits effects which are similar to those described above.

It is also possible to use devices which operate as an inkjet recording system, where the resolution converting section 30, the color converting section 32, the quantizing section 34, the ink ejecting data generating section 36, and the reaction liquid ejecting data generating section 44 are not provided at one device, and these sections (or some of these sections) are provided at different devices.

Further, in the above, description is given by using as an example a so-called FWA (Full Width Array) inkjet recording device which has an elongated head having a width which is substantially equal to the width of the recording sheet, and which carries out recording while the head is fixed and only the recording sheet is conveyed. However, the present invention is also applicable to PWA (Partial Width Array) inkjet recording devices which carry out printing by, while scanning a head in a main scanning direction, moving a recording sheet in a subscanning direction.

As described above, the present invention has the excellent effects of enabling ejection of reaction liquid drops without bias, and enabling reaction liquid to be ejected appropriately in accordance with the image to be formed.

What is claimed is:

1. A data generating device generating reaction liquid ejecting data which is used in an image forming device which forms an image by ejecting an ink drop on the basis of ink drop ejecting data and ejecting a reaction liquid drop, which reacts with the ink drop, on the basis of the reaction liquid ejecting data, wherein the data generating device generates the reaction liquid ejecting data pixel by pixel on the basis of ink drop ejecting data of a pixel of interest, an error which was diffused to the pixel of interest from a peripheral pixel when reaction liquid ejecting data was generated previously for the peripheral pixel, and a predetermined ratio of a reaction liquid amount to an ink amount, and the data generating device carries out, for each pixel of interest, adding the predetermined ratio and the diffused error in accordance with the ink drop electing data of the pixel of interest, generating the reaction liquid ejecting data of the pixel of interest in accordance with results of comparison of a threshold value and a sum of the predetermined ratio and the diffused error, and diffusing a difference between the sum and the reaction liquid ejecting data to a peripheral pixel as the error.

2. The data generating device of claim 1, wherein the data generating device diffuses the error in units of blocks, when an image is divided into a plurality of blocks structured by a plurality of pixels.

3. An image forming device forming an image by ejecting an ink drop and a reaction liquid drop which reacts with the ink drop, the image forming device comprising:

an ink drop ejecting data generating component which, on the basis of image data, generates ink drop ejecting data for ejecting an ink drop;

the data generating device of claim 2; and an image forming component which forms an image by ejecting the ink drop on the basis of the ink drop ejecting data, and ejecting the reaction liquid drop on the basis of the reaction liquid ejecting data.

4. The data generating device of claim 1, wherein the predetermined ratio can be changed in accordance with at least one of image data used for generating the ink drop ejecting data, ink color, a type of ink drop, a number of colors of inks needed in order to form the pixel of interest, a pixel position, and an output mode.

5. An image forming device forming an image by ejecting an ink drop and a reaction liquid drop which reacts with the ink drop, the image forming device comprising:

an ink drop ejecting data generating component which, on the basis of image data, generates ink drop ejecting data for ejecting an ink drop;

the data generating device of claim 4; and an image forming component which forms an image by ejecting the ink drop on the basis of the ink drop ejecting data, and ejecting the reaction liquid drop on the basis of the reaction liquid ejecting data.

6. The data generating device of claim 1, wherein the predetermined ratio with respect to black ink is larger than the predetermined ratio with respect to other ink.

7. The data generating device of claim 1, wherein the predetermined ratio with respect to yellow ink is smaller than the predetermined ratio with respect to other ink.

8. The data generating device of claim 1, wherein the predetermined ratio with respect to data expressing a large ink drop amount is larger than the predetermined ratio with respect to data expressing an ink drop amount that is smaller than the data expressing the large ink drop amount.

9. The data generating device of claim 1, wherein, when the ink drop ejecting data of the pixel of interest is for only yellow ink, the reaction liquid ejecting data of the pixel of interest is generated such that no reaction liquid is ejected.

10. The data generating device of claim 1, wherein the predetermined ratio differs in accordance with a liquid drop ejector ejecting ink at the pixel of interest.

11. The data generating device of claim 1, wherein adding of the predetermined ratio is carried out a number of times that is equal to the number of ink types to be ejected at the pixel of interest, and each predetermined ratio added at a second or subsequent time is smaller than the predetermined ratio added at a directly preceding time.

12. An image forming device forming an image by ejecting an ink drop and a reaction liquid drop which reacts with the ink drop, the image forming device comprising:

an ink drop ejecting data generating component which, on the basis of image data, generates ink drop ejecting data for ejecting an ink drop;

the data generating device of claim 1; and an image forming component which forms an image by ejecting the ink drop on the basis of the ink drop ejecting data, and ejecting the reaction liquid drop on the basis of the reaction liquid ejecting data.

13. A data generating method generating reaction liquid ejecting data which is used in an image forming device which forms an image by ejecting an ink drop on the basis of ink drop ejecting data and ejecting a reaction liquid drop, which reacts with the ink drop, on the basis of the reaction liquid ejecting data, wherein the reaction liquid ejecting data is generated pixel by pixel on the basis of ink drop ejecting data of a pixel of interest, an error which was diffused to the pixel of interest from a peripheral pixel when reaction liquid ejecting data was generated previously for the peripheral pixel, and a predetermined ratio of a reaction liquid amount to an ink amount, and for each pixel of interest, the predetermined ratio and the diffused error in accordance with the ink drop ejecting data of the pixel of interest are added, the reaction liquid ejecting data of the pixel of interest are generated in accordance with results of comparison of a threshold value and a sum of the predetermined ratio, and a difference between the sum and the reaction liquid ejecting data is diffused to a peripheral pixel as the error.

14. An image forming method forming an image by ejecting an ink drop and a reaction liquid drop which reacts with the ink drop, the image forming method comprising:

on the basis of image data, generating ink drop ejecting data for ejecting an ink drop;

generating reaction liquid ejecting data for ejecting a reaction liquid drop according to the method of claim 13; and forming an image by ejecting the ink drop on the basis of the ink drop ejecting data and ejecting the reaction liquid drop on the basis of the reaction liquid ejecting data.

15. A storage medium readable by a computer, the storage medium storing a program of instructions executable by the computer to perform a function for generating reaction liquid ejecting data which is used in an image forming device which forms an image by ejecting an ink drop on the basis of ink drop ejecting data and ejecting a reaction liquid drop, which reacts with the ink drop, on the basis of the reaction liquid ejecting data, wherein the reaction liquid ejecting data is generated pixel by pixel on the basis of ink drop ejecting data of a pixel of interest, an error which was diffused to the pixel of interest from a peripheral pixel when reaction liquid ejecting data was generated previously for the peripheral pixel, and a predetermined ratio of a reaction liquid amount to an ink amount, and for each pixel of interest, the predetermined ratio and the diffused error in accordance with the ink drop ejecting data of the pixel of interest are added, the reaction liquid ejecting data of the pixel of interest are generated in accordance with results of comparison of a threshold value and a sum of the predetermined ratio, and a difference between the sum and the reaction liquid ejecting data is diffused to a peripheral pixel as the error.

16. The storage medium of claim 15, wherein the error is diffused in units of blocks, when an image is divided into a plurality of blocks structured by a plurality of pixels.

17. The storage medium of claim 15, wherein the predetermined ratio can be changed in accordance with at least one of image data used for generating the ink drop ejecting data, ink color, a type of ink drop, a number of colors of inks needed in order to form the pixel of interest, a pixel position, and an output mode.

* * * * *